US008555526B2

(12) United States Patent
Elnekaveh

(10) Patent No.: US 8,555,526 B2
(45) Date of Patent: Oct. 15, 2013

(54) RESILIENT SHOE WITH PIVOTING SOLE

(76) Inventor: Alexander Elnekaveh, Sherman Oaks, CA (US)

( * ) Notice: Subject to any disclaimer, the term of this patent is extended or adjusted under 35 U.S.C. 154(b) by 0 days.

(21) Appl. No.: 13/455,030

(22) Filed: Apr. 24, 2012

(65) Prior Publication Data

US 2012/0204442 A1 Aug. 16, 2012

Related U.S. Application Data

(63) Continuation of application No. 13/352,272, filed on Jan. 17, 2012, which is a continuation-in-part of application No. 12/642,642, filed on Dec. 18, 2009, now abandoned, which is a continuation-in-part of application No. 11/804,803, filed on May 21, 2007, now abandoned.

(60) Provisional application No. 60/889,725, filed on Feb. 13, 2007.

(51) Int. Cl.
*A43B 13/28* (2006.01)
*A43B 13/20* (2006.01)

(52) U.S. Cl.
USPC ..... 36/27; 36/103

(58) Field of Classification Search
USPC ..... 36/27, 37, 38, 103, 25 R, 35 R, 30 A, 36/102, 28, 3 B, 3 R, 3 A, 29
See application file for complete search history.

(56) References Cited

U.S. PATENT DOCUMENTS 1,094,211 A * 4/1914 Jenoi et al. ..... 36/38
1,469,920 A * 10/1923 Dutchak ..... 36/38
1,942,312 A * 1/1934 Tutoky ..... 36/38
2,266,476 A * 12/1941 Riess ..... 36/3 B
2,863,230 A * 12/1958 Cortina ..... 36/29
5,282,325 A * 2/1994 Beyl ..... 36/27
5,505,010 A * 4/1996 Fukuoka ..... 36/3 B
5,515,622 A 5/1996 Lee
5,649,374 A * 7/1997 Chou ..... 36/27
5,706,589 A * 1/1998 Marc ..... 36/27
5,743,028 A * 4/1998 Lombardino ..... 36/27
5,768,802 A * 6/1998 Bramani ..... 36/28
5,975,861 A * 11/1999 Shin et al. ..... 417/234
6,082,024 A * 7/2000 Del Biondi ..... 36/28
6,209,226 B1 * 4/2001 Squadroni ..... 36/3 B
6,393,731 B1 * 5/2002 Moua et al. ..... 36/27
6,463,679 B1 * 10/2002 Buttigieg ..... 36/3 B (Continued)

FOREIGN PATENT DOCUMENTS

EP 2189075 5/2010

*Primary Examiner* — Jila M Mohandesi

(74) *Attorney, Agent, or Firm* — Lauson & Tarver, LLP.; Robert J. Lauson, Esq.; Edwin P. Tarver, Esq.

(57) ABSTRACT

An improved resilient shoe sole includes an outsole having a substantially inelastic side wall with a heel cavity. A substantially inelastic platform is located below the heel cavity, and a connector connects the platform with the side wall. The connector has a particular length and thickness to maintain the platform substantially below the sidewall when the shoe sole is not under a wearer's weight. When brought under forces of a wearer's weight, the connector bends and stretches as the spring compresses to allow the platform to deflect into the heel cavity. As weight is removed, the connector and spring cause the platform to deflect out of the heel cavity, biasing the platform below the side wall.

15 Claims, 12 Drawing Sheets

(56) References Cited

U.S. PATENT DOCUMENTS

| | | | | |
|---|---|---|---|---|
| 6,996,922 | B2 * | 2/2006 | Ryoo | 36/7.8 |
| 7,578,077 | B2 * | 8/2009 | Marc | 36/103 |
| 7,681,329 | B2 * | 3/2010 | Fu | 36/3 B |
| 8,220,182 | B2 * | 7/2012 | Righetto | 36/28 |
| 2005/0204584 | A1 * | 9/2005 | Ryoo | 36/27 |
| 2008/0141559 | A1 * | 6/2008 | Marc | 36/27 |

* cited by examiner

RESILIENT SHOE WITH PIVOTING SOLE

RELATED APPLICATION DATA

The present application is a continuation of U.S. application Ser. No. 13/352,272, entitled "Improved Resilient Shoe with Pivoting Sole" filed Jan. 17, 2012, which is a continuation in part of U.S. application Ser. No. 12/642,642, entitled "Resilient Sports Shoe" filed Dec. 18, 2009 and now abandoned, which is a continuation in part of U.S. application Ser. No. 11/804,803 entitled "Improved Ventilated And Resilient Shoe Apparatus And System" filed May 21, 2007 and now abandoned, which claims the benefit of U.S. Provisional Application No. 60/889,725 entitled "Shoe with Resilient Heel" filed Feb. 13, 2007.

BACKGROUND

1. Field of the Preferred Embodiment

This invention pertains generally to wearable articles for the feet, and more particularly to shoes having a resilient sole having a shock-absorbing platform and heel cavity, possibly with air movement through the sole.

2. Description of the Related Art

Conventional shoes are often uncomfortable due to a lack of resiliency in the sole, particularly in the heel area. Inflexible heels do not promote walking or standing for long periods of time because they lack substantial cushioning and resiliency to accommodate pressure exerted on a wearer's feet. This lack of cushioning causes undue pressure and force-of-impact to be felt up into the knees, spine, and various other joints. Compressible heels having recessed chambers and springs in some cases are not new. None of the prior art successfully cushions a wearer's feet to the extent of the instant invention. Conventional shoes also fail to provide a flow of fresh air through the inside of the sole around an individual's feet.

For instance, U.S. Pat. No. 1,471,042 to Lewis (1923) discloses a shoe that uses coil springs internal to the defined heel. Lewis' shoe, however, uses metal plates (circular metal disks) above and below the coil spring(s) to help distribute pressure and also has no real cavity or resiliency in the sole. U.S. Pat. No. 2,257,482 to Resko (1941) discloses using lugs to better seat the coil spring in the defined heel, but still uses a metal reinforcing plate between the upper and lower soles to distribute pressure, also lacking resiliency in the heel. U.S. Pat. No. 3,886,674 to Pavia (1975) discloses a shoe having a plurality of springs in a non-defined, open heel. Because the springs are not enclosed, there is no sidewall surrounding the heel area. Further, there is a metal plate above the springs in the heelstrike area, so the wearer's foot still strikes against a hard surface.

Another family of prior art patents has addressed heel/cavity design. For instance, U.S. Pat. Nos. to Bunns 1,502,087, Denk 2,299,009, Carroll 6,622,401, and Dixon 5,544,431, and U.S. patent application Ser. No. 10/022,477 to Wu disclose cavities in well defined heels. Lombardino U.S. Pat. No. 5,743,028 discloses a blended heel, but lacks a platform connected to a substantially inelastic sidewall by virtue of a discrete deformable area. Consequently, movement is limited to a hinge-like articulating movement in the heelstrike area.

Still other patents, for instance U.S. Pat. No. 7,159,338 to LeVert et al., disclose a spring cushioned shoe with an inner vacuity connected by a passageway to an opening on the exterior of the shoe. The passageway opening described in the '338 patent, however, is both an inlet and an outlet and thus undesirably allows fluids and other unwanted debris into the shoe to the discomfort of the wearer and associated problems from water and mold developing within the shoe. Similarly, U.S. Pat. No. 1,069,001 to Guy discloses a cushioned sole and heel that allows air or other fluids in through a check valve to serve as the cushioning medium.

U.S. Pat. No. 5,505,010 to Fukuoka discloses a shoe having a resilient heel having a circular convexity (2*b*) and a ring-shape groove (2*c*) surrounding the convexity. While in this structure the convexity is capable of moving independently of other parts of the sole, Fukuoka requires a ring-shape groove (2*c*) of varying thickness, which tends to create an area of weakness, prone to breakage and malfunction. Thus, a needs exists for an improved ventilated and resilient shoe that overcomes the numerous limitations and problems in the prior art.

SUMMARY

The present invention solves the above-mentioned problems in convention shoes by providing an improved resilient and ventilated shoe apparatus and system.

The invention includes a novel shoe in one embodiment that is ventilated with external air. The apparatus and system circulate air around the wearer's foot without impacting the stability or comfort of an individual's walk. Circulating air throughout the shoe while an individual is walking provides an additional benefit that conventional shoes do not provide: reducing athlete's foot and foot odor. Conventional shoes do not allow the free flow of air throughout the inside of the shoe. Moisture and bacteria build up inside most conventional shoes, causing athlete's foot and making such shoes smell. The present invention provides that with every step, the individual is circulating fresh air throughout the shoe and around his foot. The result is a shoe interior that will not be a breeding ground for odor-causing bacteria. The wearer's feet will feel refreshed and better rested at the end of the day. Individuals may also find themselves walking longer distances in the improved shoes because their feet will feel more comfortable.

In an embodiment, air enters the shoe from outside around the wearer's foot and flows through openings in a sole and then through aeration chambers. The air thereafter circulates to an air suction valve in the heel and then is directed out to the exterior of the shoe through a one-air air exhaust valve and thereby ventilates the wearer's foot with free flowing air. In other embodiments, the invention includes an air pump in the heel that operates with the one way air suction valve for air intake and operates to expel air through the one-way air exhaust valve. In further embodiments, the invention includes an upper sole with a plurality of air suction holes or openings and a lower sole made from porous, air permeable material such as open cell foam or the like. In one or more embodiments, the shoe includes bacteria fighting chemicals or other substances known to persons skilled in the art to reduce shoe odor.

One embodiment of the invention includes a blended heel made from a resilient material and has a cavity extending under the entire instep portion of the shoe's upper. Compression springs are placed in the cavity, including a mainspring located at approximately the heelstrike point and two auxiliary springs for stability located forward of the mainspring toward the shoe's toe. The extended cavity provides even resiliency throughout the upper sole without having to resort to metal plates. The springs assist the resilient walls of the cavity, which extends under the instep portion of the shoe, in supporting the wearer's foot, and the spring's compression load is distributed throughout the sole by a resilient layer of softer rubber adjacent the sole.

The blended heel of the invention extends under the sole in a wedge-type configuration. This extension provides arch support and resiliency at the shoe's instep, or midsole. In one or more embodiments, the heel includes a height enhancer to provide lift without the appearance of "elevator shoes." This pad located under the heel portion also serves to distribute the load of the springs and provides that the entire shoe is lifted, not just the wearer's foot.

In one embodiment, the springs include a mainspring and two smaller auxiliary springs in front of and evenly spaced to the inside and outside of the mainspring. The mainspring offers lift to the wearer reducing, if not eliminating, pressure on the wearer's spine, knees, and other joints. The auxiliary springs offer stability and additional absorption of the pressure forces generated from walking and other activity. In one or more embodiments, the springs are made from industrial grade aluminum spring material or many other suitable materials are within the scope of the invention. For example, instead of metallic springs, other spring members such as air balls or rubber balls could be used. The springs are aided by the resilient material itself that makes up the heel and the cavity walls.

One embodiment of the invention includes a magnetic sleeve that serves to further enhance the well-being of the wearer. Such an insert uses magnetic therapy technology to offer the wearer the additional benefit of enhancing blood circulation in the heel, foot, and ankle areas.

In another embodiment, a shoe includes a resilient sole and heel cavity. The sole includes an outsole with a substantially inelastic sidewall, a substantially inelastic platform having a perimeter wall, or height, and an elastic connector between the sidewall and perimeter wall. The connector limits movement of the platform relative to the sidewall between a substantially unloaded position where the connector maintains the platform substantially below the sidewall, and a substantially loaded position, where the connector is deformed so that the platform is deflected to some degree into the heel cavity and substantially surrounded by the sidewall.

It is anticipated the shoe may have a spring spanning the heel cavity, the spring located atop the platform. It may require between 50 and 700 pounds of pressure to fully compress the spring and connector.

In an unloaded position, the platform may be maintained between two and twenty five millimeters below the sidewall. Also, in the unloaded position, the connector may be between one and ten millimeters in length between the sidewall and platform, and have a thickness of between one and ten millimeters.

The platform, sidewall, and connector may be constructed from a single, unitary piece of material, preferably rubber, although it is also anticipated the sidewall may be made of thermoplastic polyurethane which in various embodiments may be clear in order to see the interior of the heel cavity. In various embodiments, the outsole may be made of materials such as ethylene vinyl acetate, polyurethane, thermoplastic polyurethane and rubber, or a combination of those materials.

The substantially inelastic sidewall, inelastic platform, spring and elastic connector are arranged such that the spring is biased to maintain the platform substantially lower than the sidewall. Under a wearer's weight, the spring compresses, causing bending and stretching of the connector, and allowing the platform to deflect substantially upward into the outsole.

In order to provide cushioned impact while walking or running, a shoe is provided having a resilient sole and heel cavity. Also provided is an outsole having a sidewall, a substantially inelastic platform, and an elastic connector between the sidewall and platform. The length or thickness of the connector is varied, depending on a user's weight or the desired performance characteristics of the shoes. After putting on the shoes, a user applies a substantial portion of the user's weight onto the sole, substantially bending and stretching the connector, and substantially deflecting the platform into the heel cavity.

As a substantial portion of the user's weight is removed from the sole, bending and un-stretching of the connector causes the platform to deflect out of the heel cavity. A spring in the heel cavity may be included and biased so as to maintain the platform outside the heel cavity.

DESCRIPTION

Figure 1:
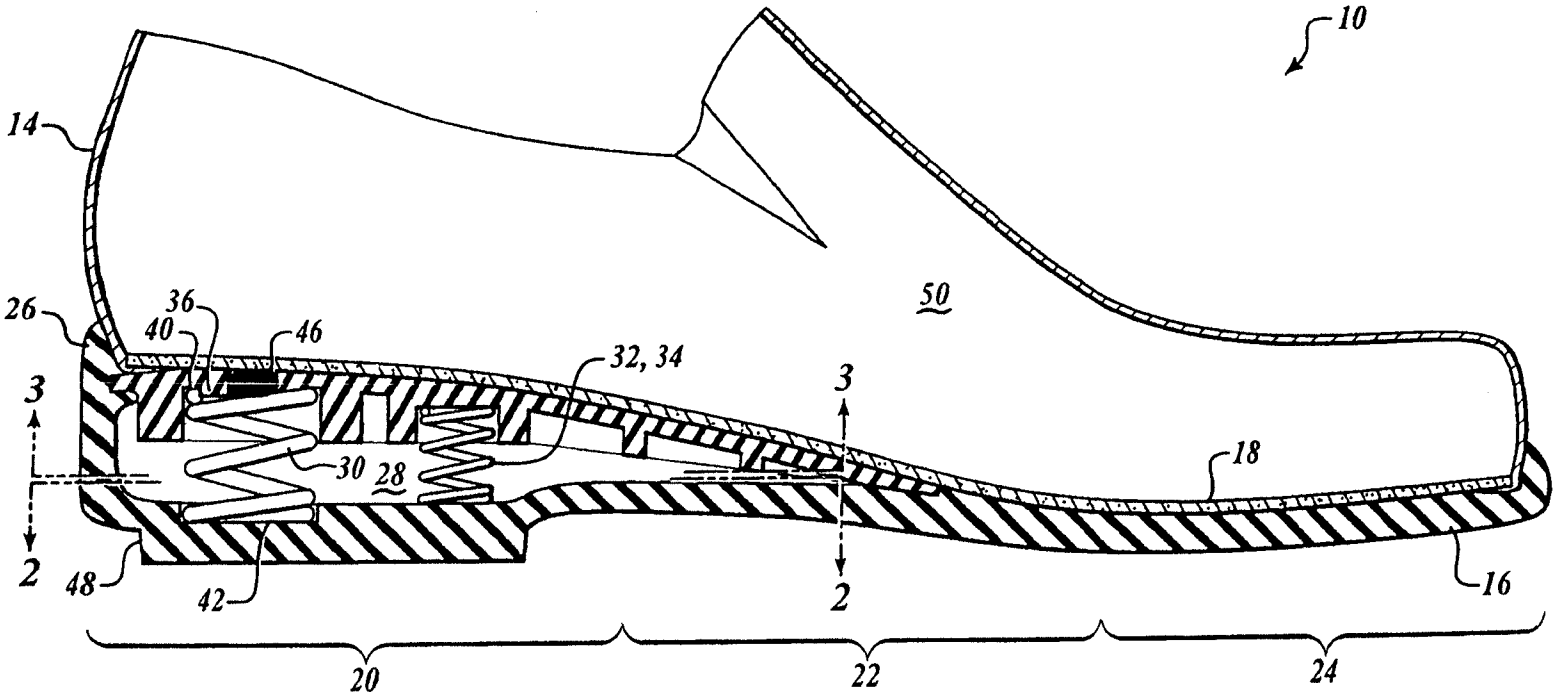
FIG. 1 is a side cutaway view of one embodiment of the shoe with resilient sole having heel cavity and compression springs.

FIG. 1 shows an embodiment of the shoe 10 with upper 14 and lower 16 joined along the upper sole 18 extending through the heel portion 20, instep portion 22, and toe portion 24. The blended heel 26 defines a cavity 28 that extends from the rearmost point of the heel portion 20 forward under the instep portion 22. The blended heel 26 is made from a resilient material, typically rubber so the cavity walls offer some resiliency, but other resilient materials known to persons skilled in the art are within the scope of the present invention.

Figure 2:
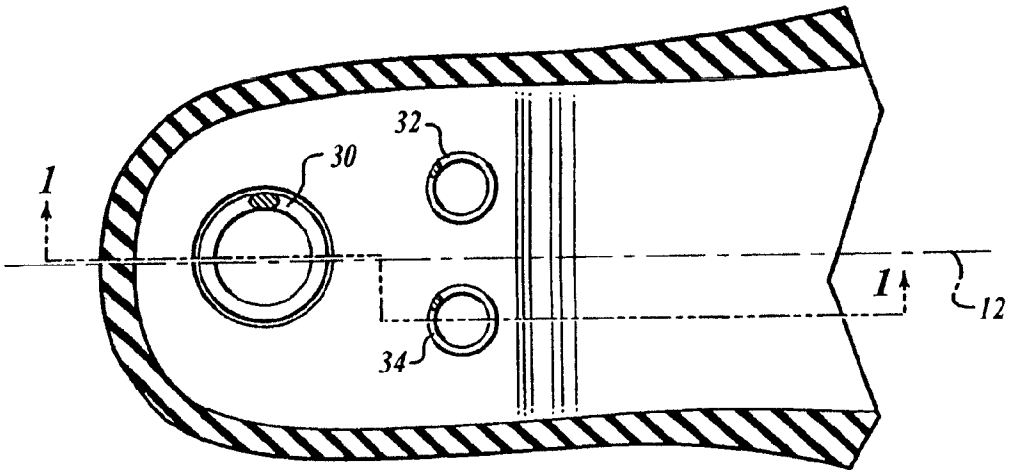
FIG. 2 is a top view of the heel area showing one possible configuration of compression springs.

Two separate materials may be used, as is shown here, with the layer adjacent the upper sole of a softer material than the remainder of the heel. The mainspring 30 is positioned orthogonal to the longitudinal axis 12, as shown in FIG. 2, and under the heelstrike point of the interior of the shoe. The mainspring 30 may be secured by lugs 36 (upper) and 38 (lower; not shown) set into recesses 40 and 42, and provides the majority of resilient force to the wearer's steps. Auxiliary springs 32 and 34 shown in FIG. 2 add stability and enhanced resiliency.

In one or more embodiments, a magnetic sleeve 46 is included as shown in FIG. 1 to further enhance the well-being of the wearer with magnetic therapy. Also, the pad 48 at the bottom of the blended heel 26 serves not only as a height-enhancer, but also helps to distribute the spring load throughout the heel portion 20 so that the entire shoe is lifted, not just the wearer's foot.

FIG. 2 shows one configuration of the springs. The mainspring 30 is located generally on the longitudinal axis 12 in the center of the shoe width, and the auxiliary springs 32 and 34 are located forward of the mainspring, toward the toe portion 24 and to either side of the longitudinal axis. The lateral spacing of the auxiliary springs 32 and 34 provides overall stability to the shoe and enhances the lift felt by the wearer.

One placement of the auxiliary springs 32 and 34 is to have them spaced evenly in front of the mainspring, equidistant from both the mainspring and the longitudinal axis, so that the wearer's ankle is not turned either inward or outward. Also in this configuration, the lift from the springs is directed upward to enhance the lift from the mainspring. On the other hand, strategic placement of the springs offset from each other may aid in the correction of pronation or other ankle alignment problems in other embodiments.

Figure 3:
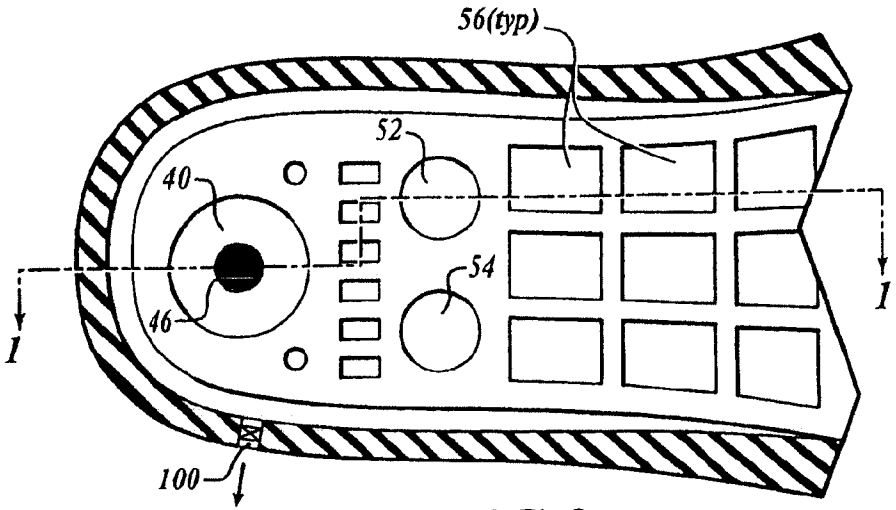
FIG. 3 is a bottom detail view of a resilient plate with lower sole and springs Removed and showing an optional one-way exit air valve.

FIG. 3 shows the recesses 40, 52, 54 for the springs in one embodiment and also shows how there may be other recesses 56 (rectangular, circular, or of any other shape) built into the rubber material to aid in overall stability. The design of these various smaller recesses 56 may aid in air circulation within the heel cavity and may work in concert with an air pressure valve to help express air from the cavity on depression thereof. In one or more embodiments, the shoe 10 includes a one-way air exhaust valve 100 as shown in FIG. 3 whereby air is expelled out the valve 100 when the heel 20 is compressed and the volume of the cavity 28 is reduced. The valve 100 is a one-way valve so that water or other unwanted debris is prevented from entering the cavity 28. The valve 100 is also such that air freely flows out rather than seeking a path in a forward direction through the sole as described in other embodiments herein.

Figure 4:
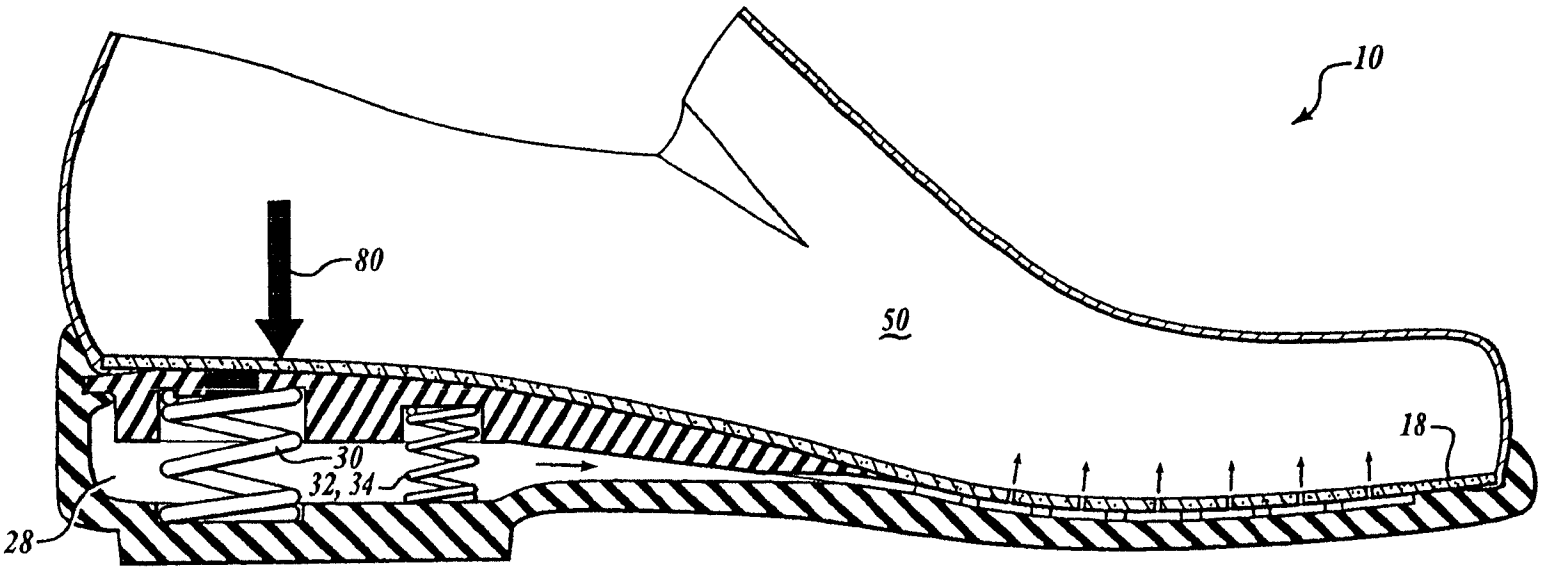
FIG. 4 is a side cutaway view of another embodiment of the shoe with resilient heel cavity and springs and showing ventilation of the inside sole.

FIG. 4 shows one embodiment where a load 80 is placed onto the shoe heel portion 20 so as to compress the mainspring 30 and the auxiliary springs 32 and 34 within the cavity 28. The cavity 28 is not sealed (and the one-way air exhaust or exit valve 100 not present), and thus when the volume of the cavity 28 is reduced air is discharged in a forward direction towards the instep portion 22 and toe portion 24 and through the upper sole 18 as shown in FIG. 4, which provides overall stability to the shoe and enhances the lift and fresh air feeling felt by the wearer.

Figure 6:
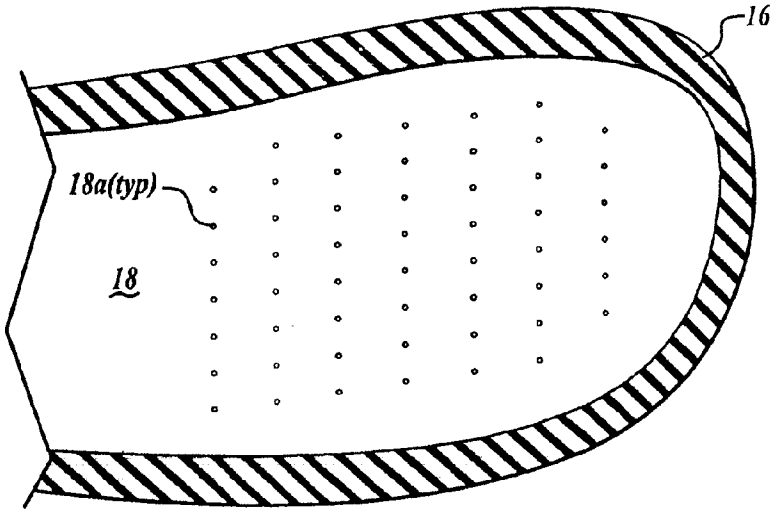
FIG. 6 is a top cutaway view of the upper sole in one or more embodiments of the invention.
Figure 5:
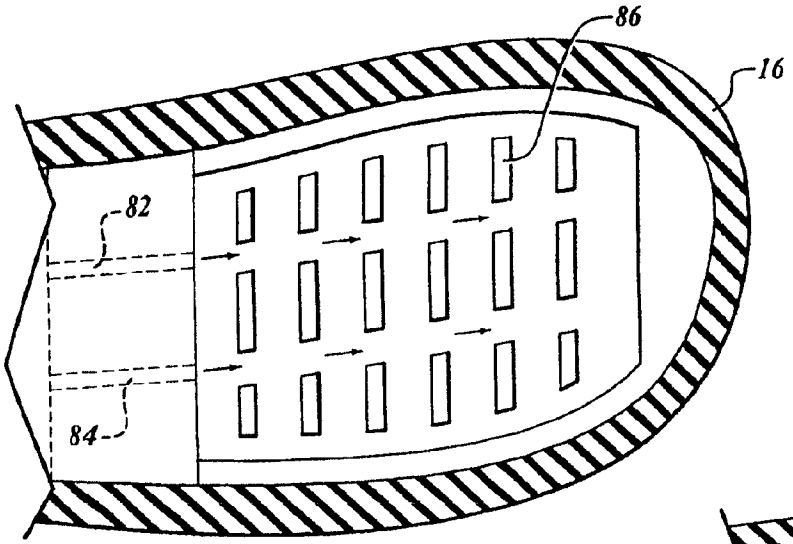
FIG. 5 is a top cutaway view of the heel portion in one or more embodiments of the invention, again showing ventilation of the inside sole.

FIG. 5 shows the air flow depicted in FIG. 4 with arrows in one embodiment within the shoe 10 through a channel structure 82 and channel structure 84 to aeration channels 86 in the instep portion 22 and toe portion 24 of the shoe 10. FIG. 6 illustrates an embodiment with the upper sole 18 includes a plurality of openings **18*a* to further facilitate the flow of air within the shoe 10**.

Figure 7:
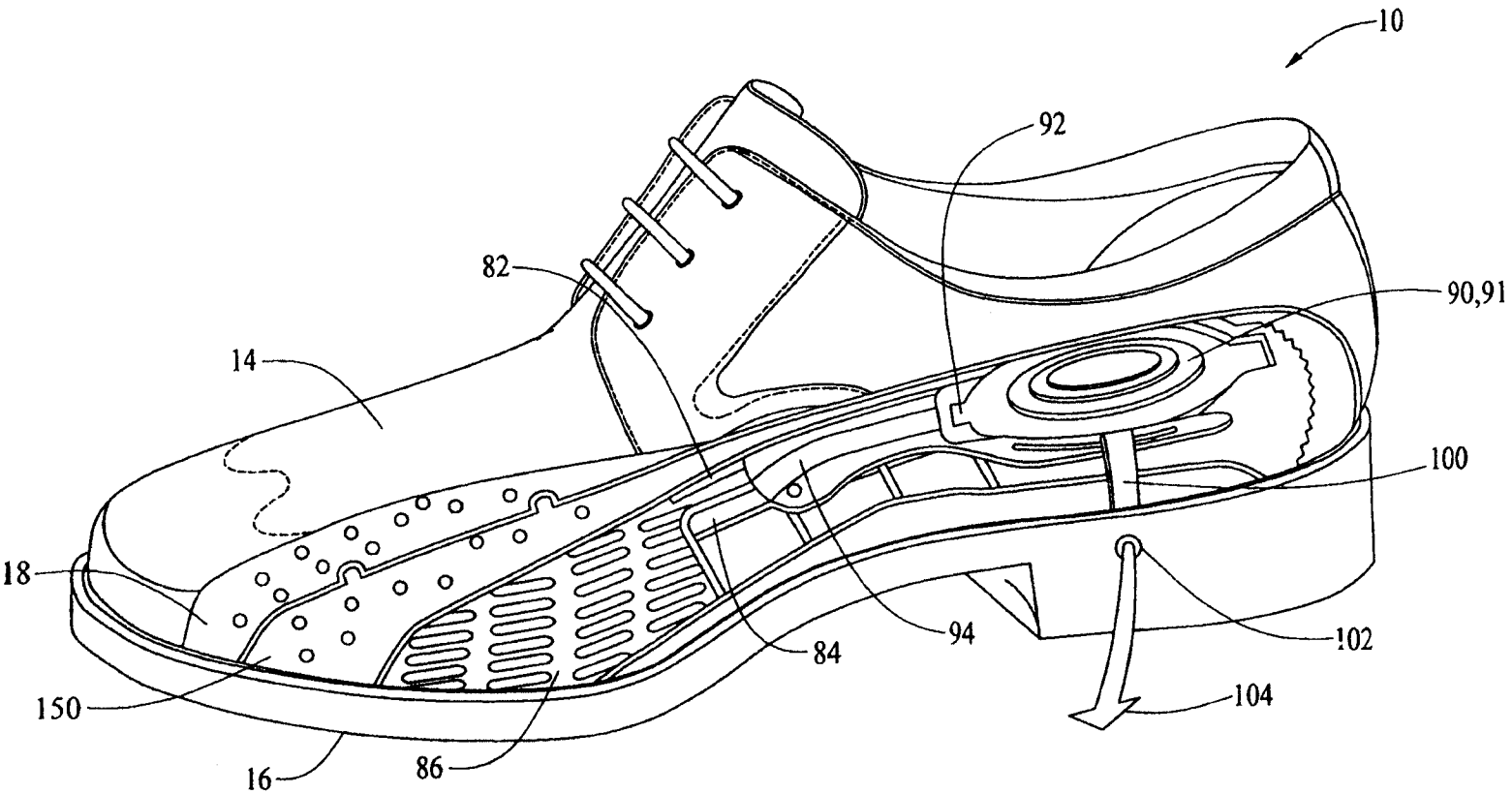
FIG. 7 is a cutaway perspective view of a variation of a ventilation apparatus and system in one or more embodiments of the invention.

FIG. 7 illustrates another embodiment of a ventilated shoe of the present invention. In this embodiment an air pump 90 is provided in the cavity 28 in the heel portion 20, rather than the cavity 28 itself in conjunction with the one way valve 100 acting in a similar manner as described above. The air pump 90 is made of a conventional construction well known to persons skilled in the art and is not described in detail here. The air pump 90 is connected to the one-way air suction valve 92 as shown in FIG. 7 and is also connected to the one-way air exhaust valve 100 also as shown in FIG. 7. The one-way air suction valve 92 is adjacent to the air channel 82 and the air channel 84, although an intermediate connecting channel 94 can be provided to connect the air channels 82 and 84 to the one-way air suction valve 92.

When the shoe 10 is used for walking, air enters the shoe adjacent to the where the user's ankle and leg are near to the shoe 10 or at or near the upper 14. The air flows through the upper sole 18 including through the openings **18*a* in the upper sole 18 to the aeration channels 86 on the lower 16 of the shoe 10. Air then flows to the air channels 82 and 84 to the one-way suction valve 92. The air then enters the air pump 90 and is expelled out the one way air exhaust valve 100 to the exterior of the shoe 10 as depicted schematically in FIG. 7 by arrow 104. In one or more embodiments, a waterproof ventilation valve 102 is provided on the exterior of the shoe 10 as shown in FIG. 7 to further inhibit water or other debris from entering the shoe 10 or cavity 28**.

The air pump 90 operates so that when it is compressed, such as by a wearer's foot while walking, the air pump 10 is compressed which forces the air in the air pump 90 out through the valve 100. When the air pump 90 expands, such as when the wearer lifts his foot and heel during a walking stride, air flows into the air pump 90 through the one-way air suction valve 92. Therefore, while walking at even a normal pace, the shoes and thus the feet of the individual wearing the inventive shoes are ventilated with fresh air. Alternatively, the air pump 90 could include a small thermoelectric device 91 to remove heat (or cold) and humidity from the inside of the shoe.

Figure 8:
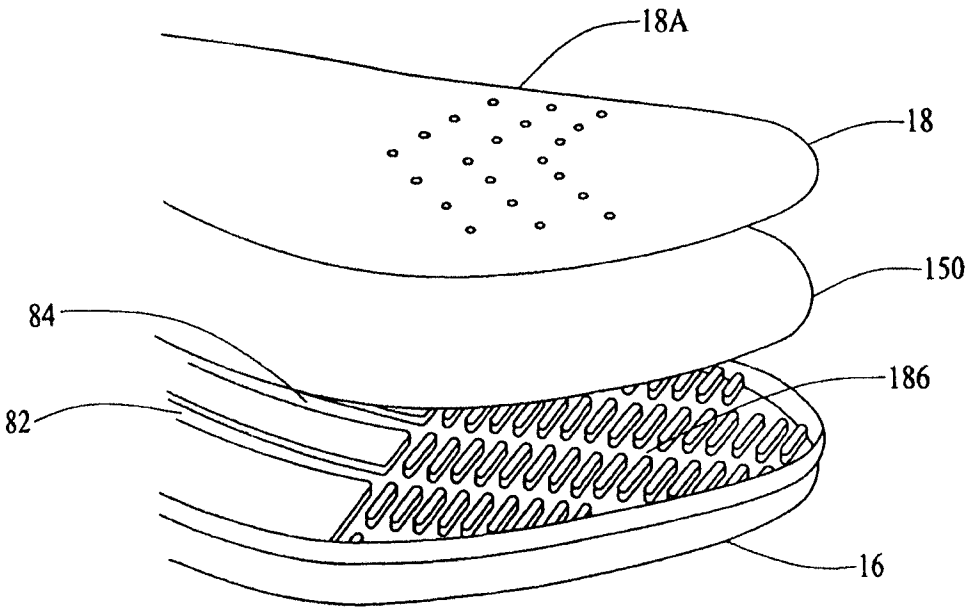
FIG. 8 is an exploded partial view of the upper sole, second sole and the bottom with the aeration channels in one or more embodiments of the invention.

FIG. 8 illustrates an embodiment which includes a lower sole 150, made from open cell foam or equivalent materials well known to persons skilled in the art, positioned between the upper sole 18 and the aeration channels 86 to further facilitate the flow of air within the shoe 10 with the upper sole 18 having a plurality of openings **18*a* as shown in FIG. 8. Alternatively, the lower sole 150 could be made of generally air impervious material having one or more large holes for air to pass from the lower 16 up through the upper sole 18**.

Figure 9:
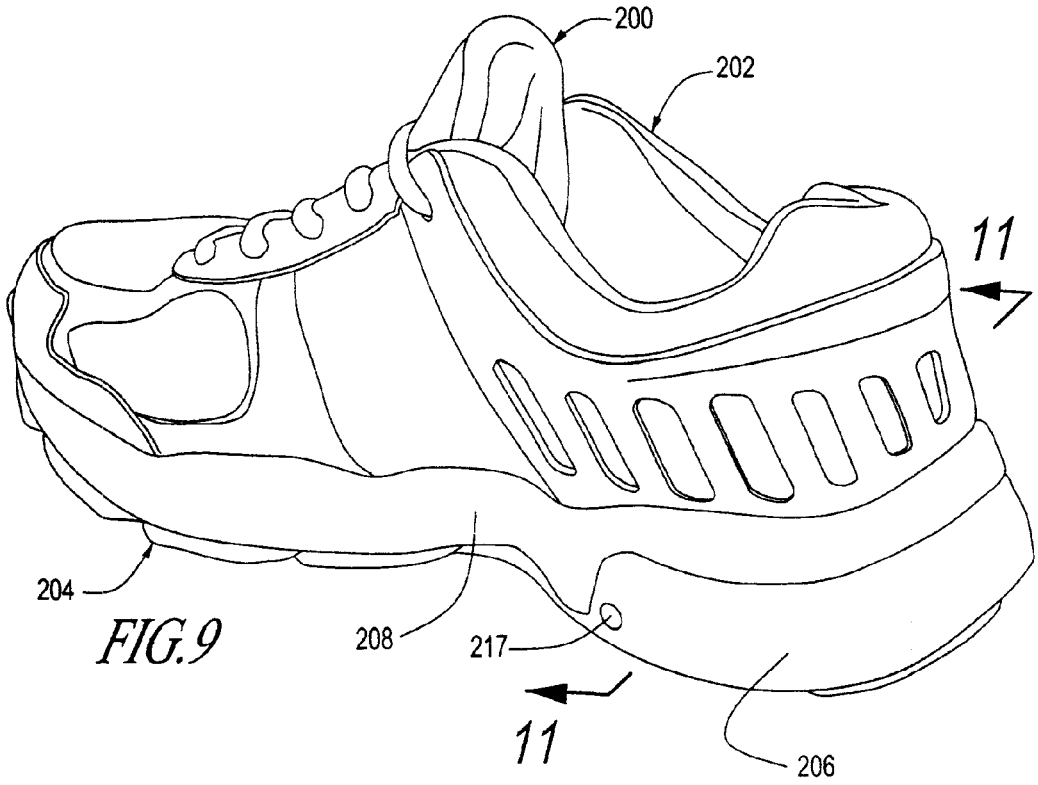
FIG. 9 is a perspective view of a second embodiment of the resilient shoe, a shoe for sporting activities.
Figure 10:
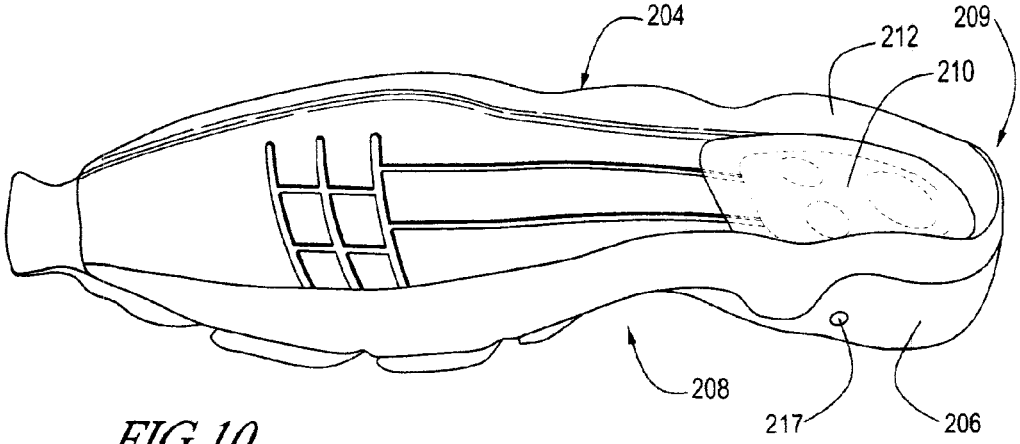
FIG. 10 is a perspective view of the lower portion of the second embodiment shoe.

FIG. 9 illustrates a second embodiment sport shoe 200 with an upper portion 202 and sole 204, wherein the sole 204 comprises an outsole 206, and a midsole 208. Referring to FIG. 10, the outsole 206 is attached to the midsole 208, together forming a heel 209. The midsole 208 includes a first part 210 and a second part 212. The first part 210 of the midsole 208 is designed to reside substantially under the heel of a wearer, while the second part 212 supports the remainder of the wearer's foot.

Figure 11A:
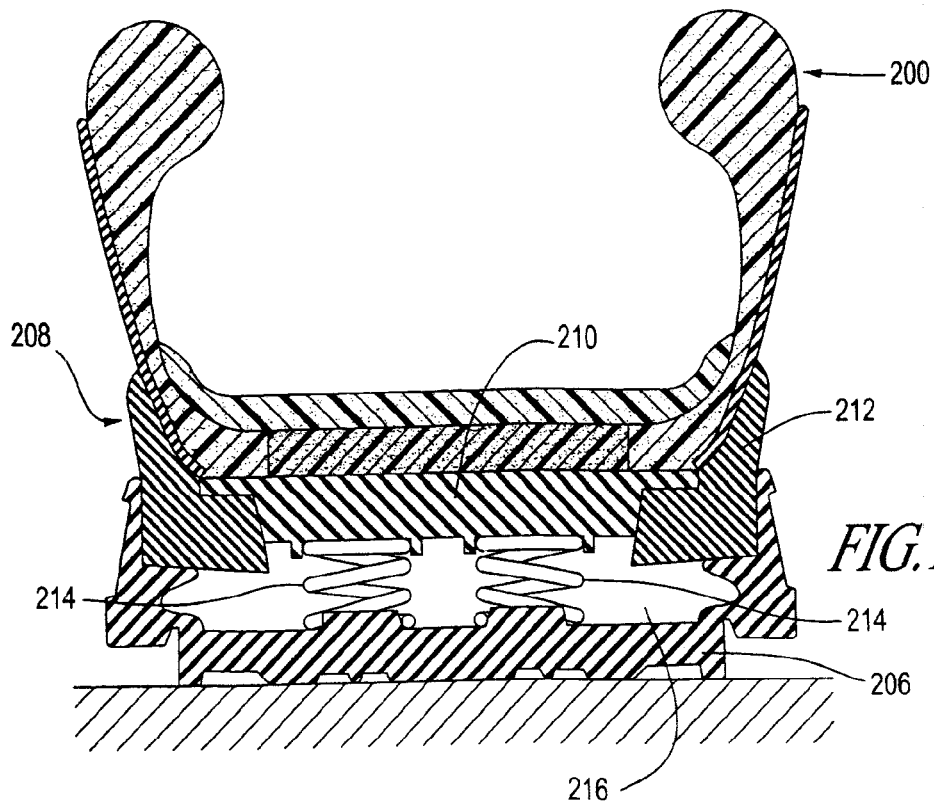
FIG. 11A is a section view through the heel portion of the second embodiment shoe in an uncompressed state.

Referring to FIG. 11A, a cross section of the sports shoe 200, outsole 206, midsole 208 and related structures are shown in an uncompressed state. Here, the first part 210 of the midsole 208 is disposed above and engaged by a series of springs 214. The bottoms of the springs 214 engage the outsole 206. The second part 212 of the midsole 208 engages the outsole 206. In this manner, downward pressure by a wearer's heel is distributed across the springs 214. FIG. 11A also illustrates the cavity 216 housing the springs 214, enclosed by the first part 210 and second part 212 of the midsole 208, and the outsole 206.

Figure 11B:
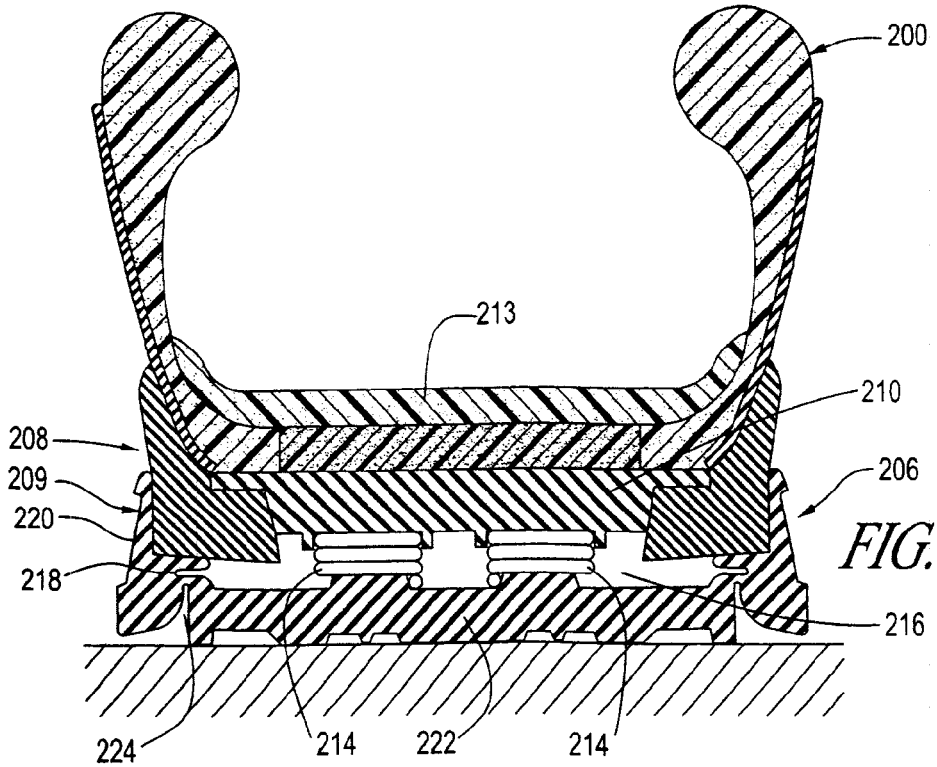
FIG. 11B is a section view through the heel portion of the second embodiment shoe in a compressed state.

Referring to FIG. 11B, the outsole 206, midsole 208 and related heel 209 structures are shown in a compressed state. In this state the springs 214 are compressed, reducing the volume of the cavity 216. The cavity 216 is preferably obscured from view by the outsole 206 forming a sidewall 220 around the heel 209 portion of the shoe 200. Preferably the springs 214 are compression springs wherein the working distance between the minimum operational state and maximum operational state is about 6 mm. Optionally, an insole 213 may be installed inside the shoe over the midsole 208.

As the springs 214 compress and cavity 216 volume decreases, the outsole 206 sidewall 220 folds together. The outsole 206 has a bottom pad 222 connected to the springs 214. The bottom pad 222 makes surface contact while the shoe is under a wearer's weight.

In order to ensure vertical movement of the springs 214 and minimize lateral displacement of the outsole 206 relative to the midsole 208, the outsole 206 comprises a connecting portion 224 between the sidewall 220 and horizontal pad 222. As the sidewall 220 deflects downward relative to the bottom pad 222, the connecting portion 224 folds inward upon itself, sandwiching the bottom pad 222 within the sidewall 220 preventing lateral displacement of the heel 209. The material comprising the connecting portion 224 is resiliently deformable and is disposed in the outsole 206 between the sidewall 220 and bottom pad 222.

Referring back to FIGS. 9 and 10, an air passageway 217 releases the air from the heel 209. In a preferred embodiment the air passageway 217 comprises a one-way valve 102 (as illustrated in FIG. 7) which expels air, and prevents air, liquid or other debris from entering back into the heel 209. A thermo-electric cooling (and/or heating) device 219 may be installed in the sole to remove heat and humidity and preserve the wearer's comfort.

The outsole 206 is preferably abrasion resistant rubber material. The bottom pad 222 of the heel 209 may be of a softer rubber, such that the bottom pad 222 itself compresses to some extent under the wearer's weight. The first part 210 of the midsole 208 comprises a rigid material, preferably thermoplastic polyurethane, and may include additives such as silica based or other nanoparticles to increase dimensional stability. The second part 212 of the midsole 208 is of a very lightweight material, preferably ethylene-vinyl-acetate.

FIGS. 12 through 15 illustrate another embodiment of a resilient shoe sole 500. In this embodiment the resilient sole 500 comprises a midsole 502, an upper foundation 504, and an outsole 506. A heel cavity 508 is disposed in the sole 500, and a cap 510 may cover the heel cavity 508. While the example illustrations show a single heel cavity 508 in the sole 500, it is contemplated that the sole 500 may have additional cavities [not shown] in other locations, and also that the heel cavity 508 may be divided into more than the single heel cavity 508 shown. It is also contemplated that the midsole 502 may be made of softer materials than the outsole 506, such as ethylene vinyl acetate, while the cap 510 may be made of harder materials, for example thermoplastic polyurethane.

In the exemplary embodiment, the heel cavity 508 may house one or more springs 512. As shown in the figures, a larger spring 512 is seated behind two smaller springs 512 to add support and stability to the sole 500. It is also contemplated that either a single spring 512 or additional springs [not shown] may be incorporated into the sole 500, including in other areas of the sole 500. Alternatively, springs 512 may be omitted altogether. In one embodiment, the spring(s) 512 may have an ideal elasticity of between 50 to 700 lb/ft$^2$.

Trampoline-like rebound in the sole 500 is achieved by the structure of the outsole 506. In addition to other structures, e.g., springs, the outsole 506 comprises a platform 514 and a sidewall 516. The sidewall 516 may be substantially rigid and extend around the heel cavity 508. In this manner, it may be designed to form the periphery of the sole's 500 heel area. The platform 514, while ideally made of resilient material, may be substantially rigid due to its thickness. The pressure required to move the platform 514 relative to the sidewall 516 determines the amount of resiliency and rebound in the sole 500. The strength of that resiliency is governed by a connector 520 connecting the platform 514 and sidewalls 516, and by the distance the platform 514 must travel so that both the platform 514 and side wall 516 encounter a common walking surface.

Figure 16:
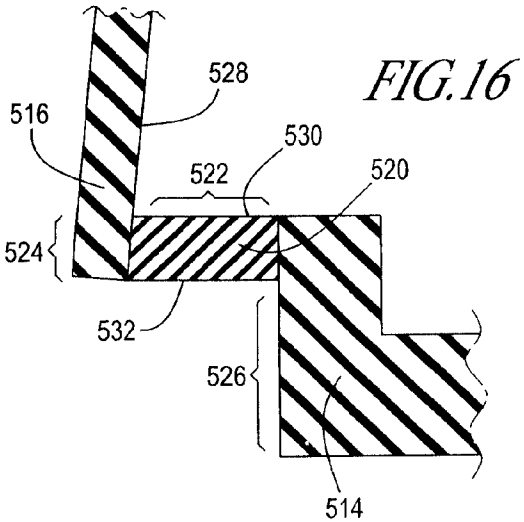
FIG. 16 is an enlarged view of the deformable area of the outsole portion of the resilient shoe sole.

Referring to FIG. 16, the connector 520 has a predetermined length 522 as measured from the perimeter wall 526 of the platform 514, and the inner, substantially vertical surface 528 of the sidewall 516, and a predetermined thickness 524, as measured from a top surface 530 of the connector 520 to a bottom surface 532 of the connector 520. While the length 522 and thickness 524 determine the force necessary to deform the connector 520, the size of the platform 514 perimeter wall 526 extends below the sidewall 516 determines the amount of rebound achieved by the sole 500.

The thickness 524 determines the shock absorbing properties of the sole 500 and the ability of the sole 500 to deflect upward when compressed on a down step. An increased thickness 524 requires more weight for full deflection. The optimum operational size for the thickness 524 is between 1 mm and 10 mm. The length 522 determines the amount of rebound in the sole 500 after deflection. It operates like a rubber band or sling shot, developing more propulsion the longer the deformable area 520 stretches. The optimum operational size for the length 522 portion of the deformable area 520 is between 1 mm and 10 mm.

The platform 514 perimeter wall 526 is used to govern the maximum amount of deflection in the sole 500. Deflection ends once the sidewall 516 of the sole 500 reaches the surface on which the platform 514 rests. The optimum operational height for the perimeter wall 526 is between 2 mm and 25 mm.

Figure 14:
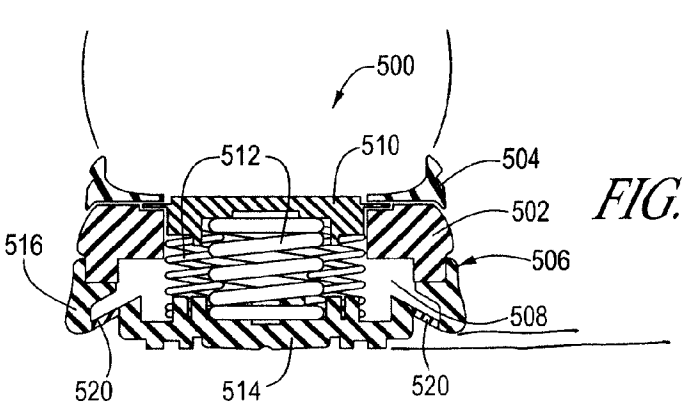
FIG. 14 is a rear view of the resilient shoe sole having a heel cavity and spring disposed therein in a compressed state.
Figure 12:
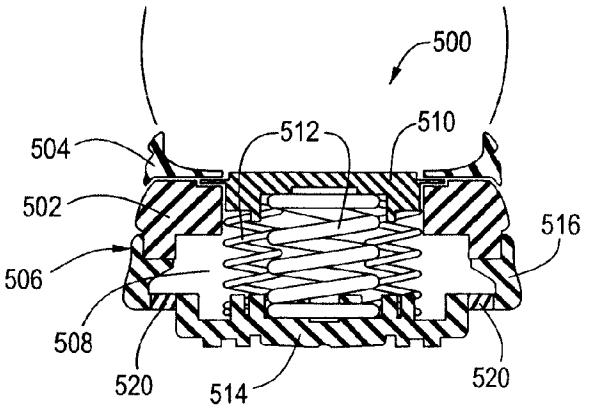
FIG. 12 is a rear view of the resilient shoe sole having a heel cavity and spring disposed therein in an uncompressed state.
Figure 13:
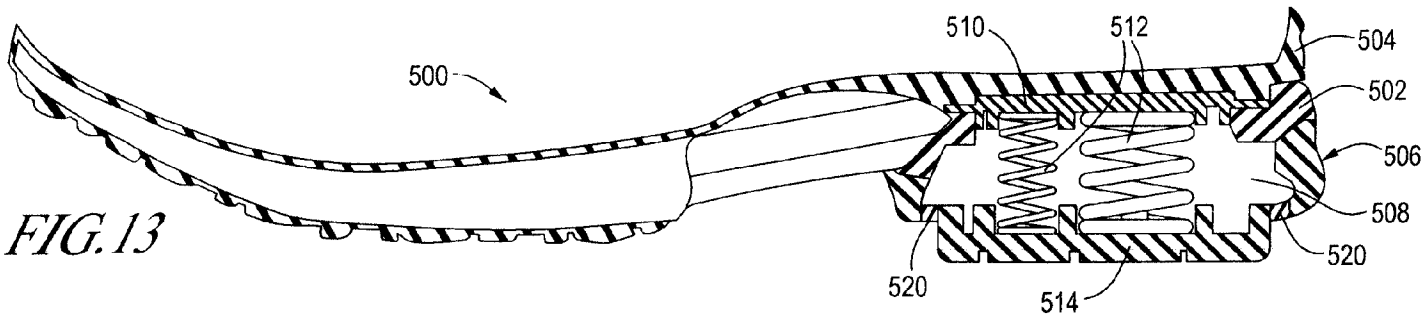
FIG. 13 is a side view of the resilient shoe sole having a heel cavity and spring disposed therein in an uncompressed state.
Figure 15:
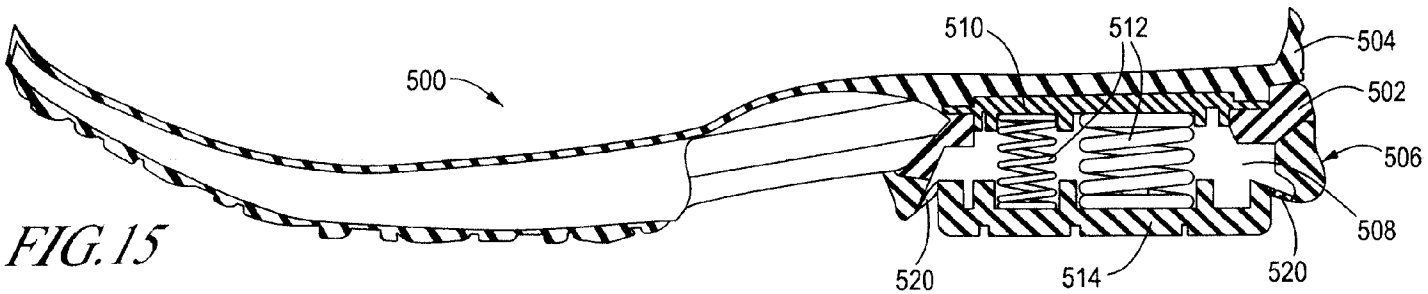
FIG. 15 is a side view of the resilient shoe sole having a heel cavity and spring disposed therein in a compressed state.

Referring back to FIGS. 12 and 13, in a resting position, the connector 520 of the outsole 506 maintains the platform 514 in a fully extended position. The connector 520 may simply be a portion of the material comprising the outsole 506. In alternative embodiments, the connector 520 may be made of material having an elasticity differing from the platform 516, sidewall 518, or both. Referring again to FIGS. 14 and 15, in a deformed position, the connector 520 of the outsole 506 is stretched such that the platform 514 is deflected upward into the cavity 508 until the sidewalls 516 of the outsole 506 reach the surface on which the platform 514 rests. It is contemplated that in certain embodiments the platform 514 may deflect only partially upward into the cavity 508 as shown in FIG. 14. Additionally, while the figures show a substantially planar connector 520 when the platform 520 is in a deflected state, it is contemplated that due to the elastic nature of the connector 520 it may deform into a curved or "S" shape when the platform 514 deflects into the cavity 508.

The ratio of the thickness 524, length 522, and the perimeter wall 526 height (and the resiliency of the spring and rubber material) have different measurements in various shoe designs: For example, it is anticipated dress shoes will be designed with maximum flexibility due to their low-impact use. Casual shoes are expected to have a middle range of flexibility for repeated impact during walking. Finally, sports or running shoes will have the lowest flexibility due to the great force of impact from sports activities. In some embodiments, the connector 520 may also be of varied size and shape due to shoe size and whether intended for male or female use. For instance, a size seven women's shoe might be calibrated for around 120 lbs of compression, while a men's size eleven shoe might be calibrated for 200 or 250 lbs on average.

Figure 17:
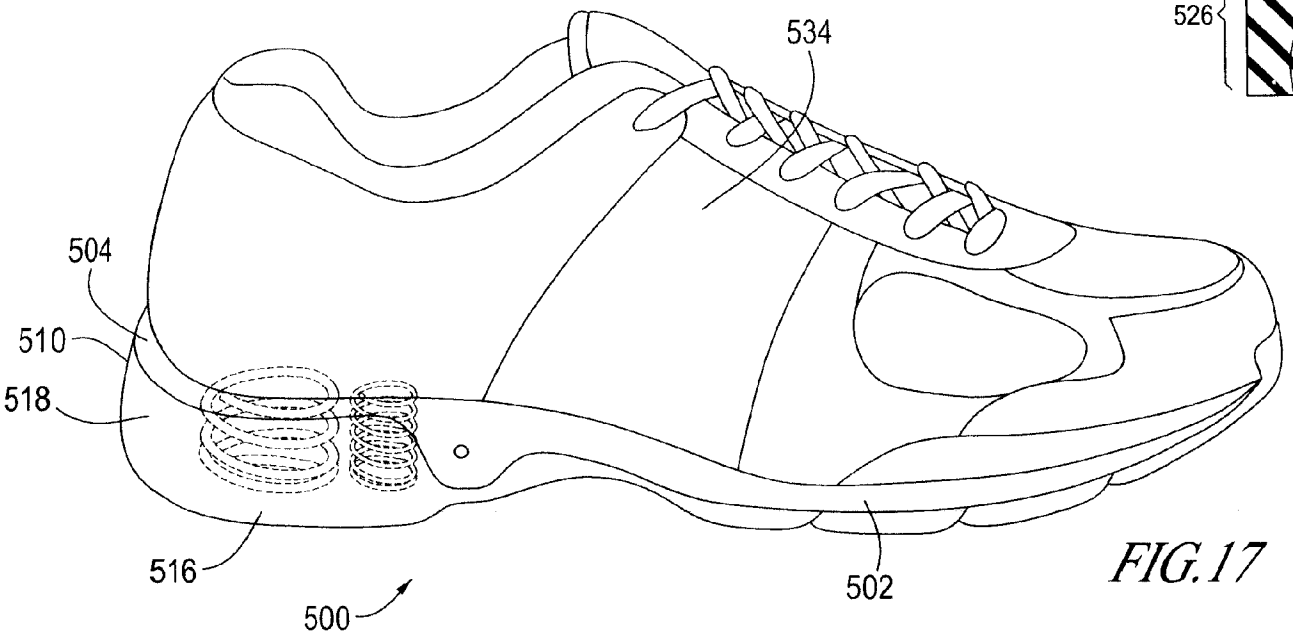
FIG. 17 is a side view of a sports shoe incorporating the resilient shoe sole.
Figure 18:
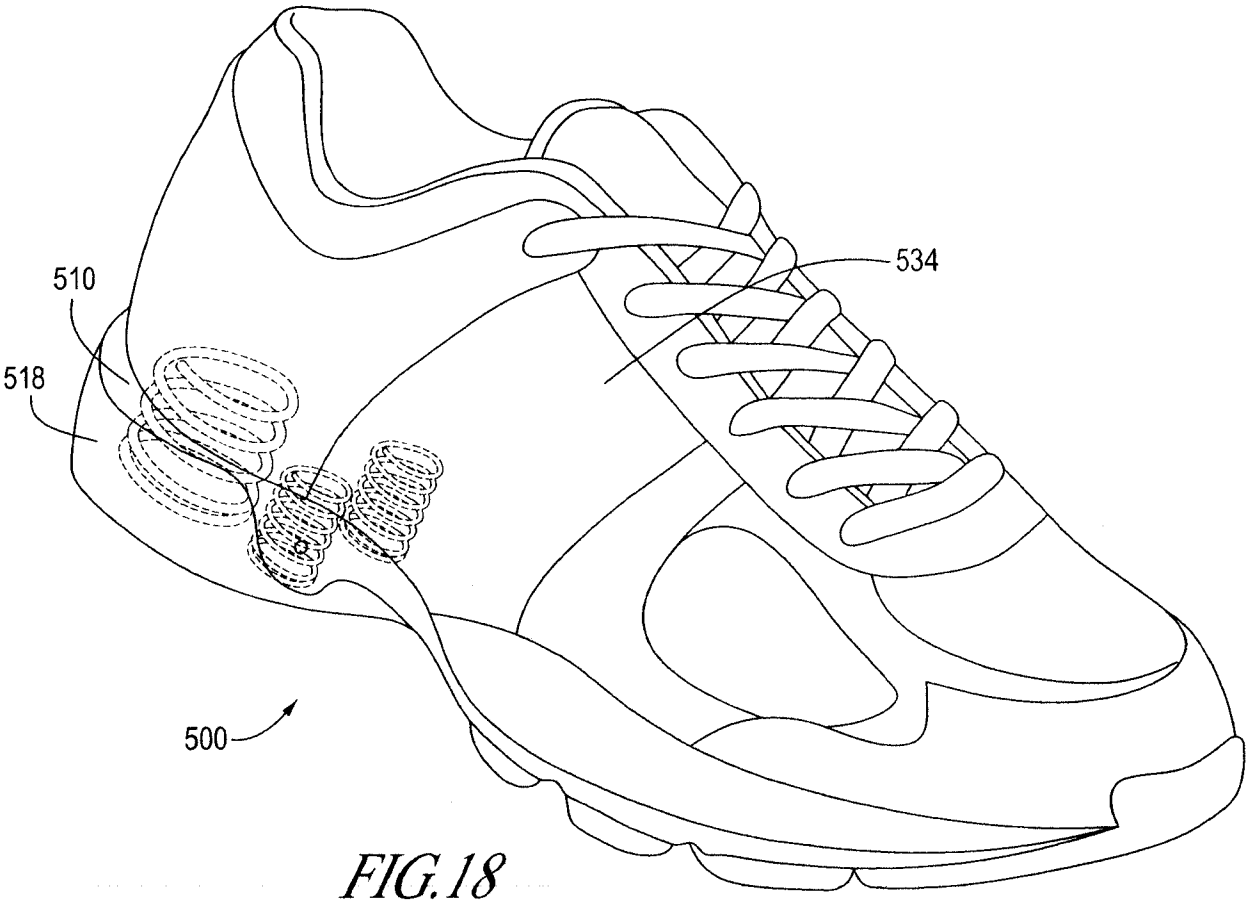
FIG. 18 is a perspective view of a sports shoe incorporating the resilient shoe sole.

Referring to FIGS. 17 and 18, the sole 500 is shown in an uncompressed state incorporated into a sports shoe upper 534. In this embodiment, the deformable area [not shown] would be configured with a greater thickness 524, length 522, or a combination of the two. The platform 514 perimeter wall 526 will have a predetermined height adapted to confer maximum stability to the shoe, which is intended for substantial lateral movement and high impact. In one embodiment, the resilient sole 500 may have a window (not shown) permitting observers to see the inner workings of the sole 500.

Figure 21:
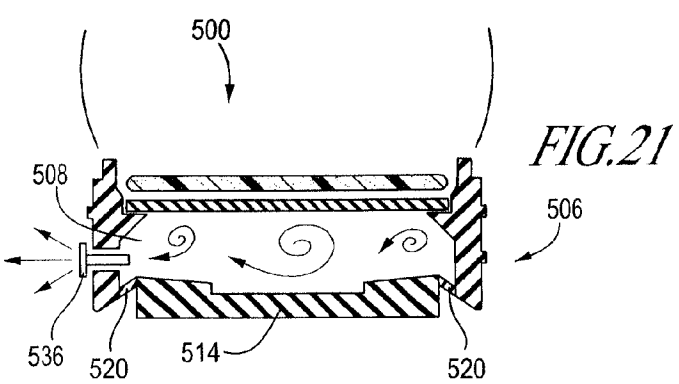
FIG. 21 is a rear view of a dress shoe incorporating the resilient shoe sole in a compressed state.
Figure 19:
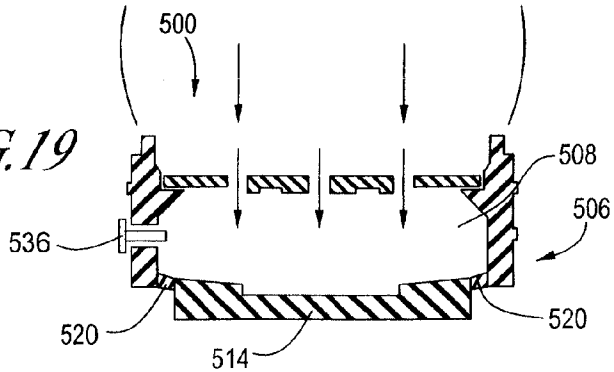
FIG. 19 is a rear view of a dress shoe incorporating the resilient shoe sole in an uncompressed state.
Figure 20:
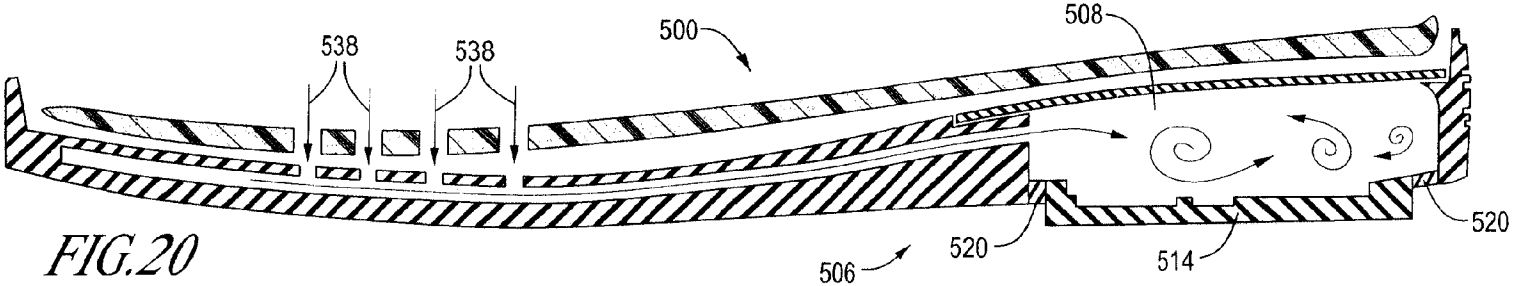
FIG. 20 is a side view of a dress shoe incorporating the resilient shoe sole in an uncompressed state.
Figure 22:
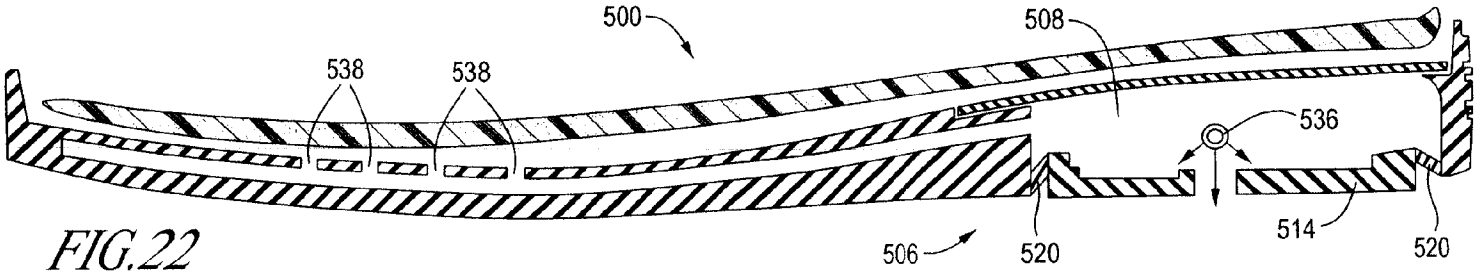
FIG. 22 is a side view of a dress shoe incorporating the resilient shoe sole in a compressed state.

Referring to 19 through 22, a spring-less dress shoe embodiment of the resilient sole 500 is shown. Referring to FIGS. 19 and 20, as in other embodiments, the connector 520 in a resting state preserves the platform 514 in a position substantially lower than the remainder of the outsole 506. Referring to FIGS. 21 and 22, as the sole 500 is compressed the deformable portion 520 allows the platform 514 to deflect upward into the heel cavity.

Also shown in this embodiment is a pneumatic cooling arrangement designed to take advantage of the changing volume of the heel cavity 508. A one-way valve 536 in the outsole 506 causes air to leave the heel cavity 508 when compressed. As the heel cavity 508 volume increases, air enters through a series of portals 538 in the sole 500. In this manner a constant flow of cooling air is achieved. It is anticipated that the pneumatic cooling arrangement may be incorporated into casual and sports shoes as well as the illustrated embodiment. It is also anticipated that the heel cavity 508 of the illustrated dress shoe embodiment may include a spring [not shown].

The structure of the resilient shoe sole 500 having been described, its operation will now be discussed.

After inserting a foot into a shoe having the resilient shoe sole 500, and lacing or otherwise fastening the foot therein, a wearer may stand, walk, jog or run in any customary manner. On a down step, as the outsole 506 approaches the ground, the platform 514 encounters a surface. As the wearer's weight is brought to bear against the shoe sole 500, the deformable area 520 begins to deform, allowing the platform 514 to depend upward into the cavity 508 of the shoe sole 500.

As discussed, the height of the edge 526 of the platform 514, the thickness of the clip 524 and the width of the lip 522 are predetermined to create a calibrated resistance depending on the weight of the user and the purpose of the shoe. In addition to the dimensions of the edge 526 and deforming area 520, it is anticipated that choice of materials may play a role in calibrating the shoe sole 500. Although rubber is one preferred material, rubber stock of differing elasticity may be used to strengthen or weaken the deformable area 520 as necessary. Other materials having resilient characteristics are also contemplated.

While the present invention has been described with regards to particular embodiments, it is recognized that additional variations of the present invention may be devised by persons skilled in the art without departing from the inventive concepts disclosed herein. By way of example, although the preferred embodiments have been shown and described in terms of men's casual or dress shoes, or sports shoes, the invention as claimed may apply to all types of shoes and even open-toed or sandals and other variations of footwear.

What is claimed is:

1. A shoe having a resilient sole and a heel cavity, worn by a user and configured to be supported by a walking surface during ambulation, comprising:

an upper having a heel portion, a toe portion, and a base extending between the heel and toe portions; and, a lower assembly coupled to the base of the upper, the lower assembly including: an intermediate sole layer underlying the heel portion of the upper; and, an outsole having a substantially inelastic sidewall, a substantially inelastic platform defining a generally planar contour peripherally offset from the inelastic sidewall, and an elastic connector bridging the peripheral offset between the inelastic sidewall and the inelastic platform; the heel cavity being defined between the intermediate sole layer and inelastic platform, the inelastic platform being substantially aligned peripherally with the heel cavity to substantially span the heel portion of the base in width;

wherein the elastic connector limits movement of the inelastic platform relative the inelastic sidewall between a substantially unloaded position wherein the elastic connector biases the inelastic platform substantially below the inelastic sidewall and the inelastic sidewall is not in contact with the walking surface, and a substantially loaded position, wherein the user applies a substantial portion of weight so that the elastic connector is deformed such that the inelastic platform is deflected into the heel cavity and substantially surrounded by the sidewall, and wherein when in the loaded position the inelastic sidewall and the inelastic platform are both in contact with the walking surface so that lateral movement of the inelastic sidewall relative to the inelastic platform is substantially prevented.

2. The shoe of claim 1 further comprising a spring spanning the heel cavity is disposed atop the inelastic platform, the spring providing the majority of resilient resistance to the user's step.

3. The shoe of claim 2 wherein between 50 and 700 pounds of pressure is required to fully compress the spring and elastic connector.

4. The shoe of claim 1 wherein in the unloaded position, the inelastic platform is maintained between two and twenty five millimeters below the inelastic sidewall.

5. The shoe of claim 1 wherein in the unloaded position, the elastic connector is between one and ten millimeters in length between the inelastic sidewall and inelastic platform.

6. The shoe of claim 1 wherein in the unloaded position, the elastic connector has a thickness of between one and ten millimeters.

7. The shoe of claim 1 wherein the inelastic platform, the inelastic sidewall, and the elastic connector are molded from a single, unitary piece of rubber.

8. The shoe of claim 1 wherein the inelastic sidewall is made of thermoplastic polyurethane.

9. The shoe of claim 8 wherein the thermoplastic polyurethane is clear.

10. The shoe of claim 1 wherein the outsole is made of a material chosen from the list of ethylene vinyl acetate, polyurethane, thermoplastic polyurethane and rubber.

11. The shoe of claim 1, further comprising a spring disposed within the heel cavity for biasing the inelastic platform, wherein the inelastic platform includes an undulating surface formed thereon retentively engaging an end of the spring.

12. A shoe having a resilient sole and a heel cavity, comprising:

an upper having a heel portion, a toe portion, and a base extending between the heel and toe portions; and, a lower assembly coupled to the base of the upper, the lower assembly including:

an intermediate sole layer underlying the heel portion of the upper;

an outsole having a substantially inelastic sidewall, and a substantially inelastic platform defining a generally planar contour peripherally offset from the inelastic sidewall;

an elastic connector bridging the peripheral offset between the inelastic sidewall and the inelastic platform, the heel cavity being defined between the intermediate sole layer and inelastic platform, the inelastic platform being substantially aligned peripherally with the heel cavity to substantially span the heel portion of the base in width; and, a spring biased to maintain the inelastic platform substantially lower than the inelastic sidewall, the spring providing the majority of resilient resistance to the user's step;

wherein under a wearer's weight the spring compresses causing bending and stretching of the elastic connector, thereby allowing the inelastic platform to deflect substantially upwardly into the outsole, wherein the inelastic platform, the inelastic sidewall and the elastic connector are molded from a single unitary piece of material.

13. The shoe of claim 2 wherein the spring is positioned at a center of a width of the shoe, and further comprising a second spring spanning the heel cavity disposed atop the inelastic platform and positioned off-center of the width.

14. The shoe of claim 13 wherein the second spring is positioned off-center at a position specifically selected to custom correct the user's gait.

15. The shoe of claim 12, wherein the inelastic platform includes a at least an undulating surface formed thereon retentively engaging an end of the spring.

* * * * *